US009644251B2

(12) United States Patent
Sakurai et al.

(10) Patent No.: US 9,644,251 B2
(45) Date of Patent: May 9, 2017

(54) CU—ZR-BASED COPPER ALLOY PLATE AND PROCESS FOR MANUFACTURING SAME

(75) Inventors: Takeshi Sakurai, Aizuwakamatsu (JP); Yoshio Abe, Aizuwakamatsu (JP); Naotake Hirano, Aizuwakamatsu (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 193 days.

(21) Appl. No.: 14/000,043

(22) PCT Filed: Feb. 10, 2012

(86) PCT No.: PCT/JP2012/053158

§ 371 (c)(1),
(2), (4) Date: Aug. 16, 2013

(87) PCT Pub. No.: WO2012/111567

PCT Pub. Date: Aug. 23, 2012

(65) Prior Publication Data

US 2013/0319584 A1 Dec. 5, 2013

(30) Foreign Application Priority Data

Feb. 18, 2011 (JP) ..... 2011-033097

(51) Int. Cl.
*C22C 9/00* (2006.01)
*C22C 9/06* (2006.01)
*C22F 1/08* (2006.01)

(52) U.S. Cl.
CPC ..... *C22F 1/08* (2013.01); *C22C 9/00* (2013.01); *C22C 9/06* (2013.01)

(58) Field of Classification Search
CPC ..... C22C 9/00; C22C 9/06; C22F 1/02
USPC ..... 420/492, 496
See application file for complete search history.

(56) References Cited

U.S. PATENT DOCUMENTS

| | | | | |
|---|---|---|---|---|
| 4,749,548 | A | 6/1988 | Akutsu et al. | |
| 4,872,048 | A | 10/1989 | Akutsu et al. | |
| 7,338,631 | B2 * | 3/2008 | Ishida et al. | 420/492 |
| 2005/0230014 | A1 | 10/2005 | Ishida et al. | |
| 2008/0041507 | A1 | 2/2008 | Ishida et al. | |
| 2010/0269959 | A1 * | 10/2010 | Gao et al. | 148/554 |
| 2011/0056596 | A1 * | 3/2011 | Oishi | B21C 1/003 148/680 |

FOREIGN PATENT DOCUMENTS

| | | | | |
|---|---|---|---|---|
| EP | 0681035 | A2 | 11/1995 | |
| EP | 1586667 | A1 | 10/2005 | |
| EP | 2343388 | A1 | 7/2011 | |
| JP | 62-70540 | | 4/1987 | |
| JP | 07-268573 | A | 10/1995 | |
| JP | 2005-298931 | A | 10/2005 | |
| JP | 2010-215935 | A | 9/2010 | |
| JP | 2010-222624 | A | 10/2010 | |
| JP | 2010-242177 | A | 10/2010 | |
| JP | 2010-248592 | A * | 11/2010 | C22F 1/08 |
| JP | 2010-248592 | A | 11/2010 | |
| WO | WO2009081664 | A1 * | 7/2009 | C22F 1/08 |

OTHER PUBLICATIONS

JP Pub. No. 2010-248592, Yamamoto et al., published Nov. 4, 2010. (machine translation).*

R. Kužel et al., "Microstructure of Equal-Channel Angular Pressed Cu and Cu—Zr Samples Studied by Different Methods," Metallurgical and Materials Transactions A, vol. 41, No. 5, Jun. 26, 2009, pp. 1174-1190.

Supplementary European Search Report dated Jul. 21, 2014, issued for the European patent application No. 12747430.2.

* cited by examiner

*Primary Examiner* — Jessee Roe
*Assistant Examiner* — John Hevey
(74) *Attorney, Agent, or Firm* — Locke Lord LLP

(57) ABSTRACT

Provided are a Cu—Zr-based copper alloy plate which retains satisfactory mechanical strength and, at the same time, has a good balance of bending formability and bending elastic limit at a high level and a process for manufacturing the Cu—Zr-based copper alloy plate. The copper alloy plate contains 0.05% to 0.2% by mass of Zr and a remainder including Cu and unavoidable impurities, and the average value of KAM values measured by an EBSD method using a scanning electron microscope equipped with a backscattered electron diffraction pattern system is 1.5° to 1.8°, the R/t ratio is 0.1 to 0.6 wherein R represents the minimum bending radius which does not cause a crack and t represents the thickness of the plate in a W bending test, and the bending elastic limit is 420 N/mm$^2$ to 520 N/mm$^2$.

4 Claims, No Drawings

CU—ZR-BASED COPPER ALLOY PLATE AND PROCESS FOR MANUFACTURING SAME

TECHNICAL FIELD

The present invention relates to a Cu—Zr-based copper alloy plate and a process for manufacturing the same, and particularly specifically, to a Cu—Zr-based copper alloy plate for electric and electronic components, which has a balance of bending workability and bending elastic limit at a high level, and a process for manufacturing the same.

This application claims the benefit of priority to Japanese Patent Application No. 2011-033097 filed Feb. 18, 2011, the contents of which are hereby incorporated by reference in their entirety.

BACKGROUND ART

Recently, along with further reduction in size of electric and electronic components such as a connector, a relay and a switch, the density of a current which flows in a contact member and a sliding member incorporated therein has been increasingly increased, and there has been an increasing demand for a material with better conductivity than in the related art. In particular, vehicle electronic components are required to reliably endure a higher temperature and vibration environment for a long period of time and desired to have excellent stress relaxation properties.

As materials capable of responding to such requirements, a Cu—Zr-based alloy can have a high conductivity of more than 80% IACS and has good heat resistance and excellent stress relaxation properties. However, there is a problem of retaining bending workability while satisfactory strength is secured, and excellent bending elastic properties are also required.

As a Cu—Zr-based copper alloy to solve such problems, in PTL 1, a copper alloy is disclosed which allows the strength and elongation to be balanced at a high level, contains, in terms of a weight ratio, 0.005% to 0.5% of Zr, and 0.2 ppm to 400 ppm of B, and has a layered structure composed in such a manner that crystal grain layers made of plural flat crystal grains continuous in a plane direction are laminated in a thickness direction. The thickness of the crystal grain layer is in a range of 20 nm to 550 nm, a peak value P in a histogram of the thickness of the crystal grain layers in the layered structure is in a range of 50 nm to 300 nm, and is also present at a frequency of equal to or more than 22% of the total frequency, and a half-value width L thereof is equal to or less than 200 nm.

In PTL 2, a copper alloy is disclosed which allows the strength and elongation to be balanced at a high level, contains, in terms of a weight ratio, 0.005% to 0.5% of Zr, and 0.001% to 0.3% of Co, and has a layered structure composed in such a manner that crystal grain layers made of plural flat crystal grains continuous in a plane direction are laminated in a thickness direction. The thickness of the crystal grain layer is in a range of 5 nm to 550 nm, a peak value P in a histogram of the thickness of the crystal grain layers in the layered structure is in a range of 50 nm to 300 nm, and is also present at a frequency of equal to or more than 28% of the total frequency, and a half-value width L thereof is equal to or less than 180 nm.

In PTL 3, a copper alloy material for electric and electronic components is disclosed which has high mechanical strength and bending formability and is obtained by rolling a copper alloy containing zirconium (Zr) of equal to or more than 0.01% by mass and equal to or less than 0.5% by mass, and a remainder including Copper (Cu) and unavoidable impurities. The orientation distribution density of Brass orientation in a texture of the copper alloy material for electric and electronic components is equal to or less than 20, and the sum of the respective orientation distribution densities of Brass orientation, S orientation and Copper orientation is equal to or more than 10 and equal to or less than 50.

CITATION LIST

Patent Literature

PTL 1: Japanese Unexamined Patent Application Publication No. 2010-215935

PTL 2: Japanese Unexamined Patent Application Publication No. 2010-222624

PTL 3: Japanese Unexamined Patent Application Publication No. 2010-242177

SUMMARY OF INVENTION

Technical Problem

While a Cu—Zr-based copper alloy for electric and electronic components in the related art has both satisfactory mechanical strength and good bending formability (elongation properties), bending elastic properties are not satisfactory.

An object of the invention is to provide a Cu—Zr-based copper alloy plate for electric and electronic components that has a balance of bending formability and bending elastic limit at a high level while retaining satisfactory mechanical strength, and a process for manufacturing the same.

Solution to Problem

As a result of an intensive study, the inventors have found that a copper alloy, containing, by mass %, 0.05% to 0.2% of Zr, and a remainder including Cu and unavoidable impurities, retains a balance of bending formability and spring bending elastic limit at a high level when an average value of KAM (Kernel Average Misorientation) values which is a misorientation among adjacent measurement points measured by an EBSD method using a scanning electron microscope equipped with a backscattered electron diffraction image system is 1.5° to 1.8°.

In addition, the inventors have further studied manufacturing processes disclosed in Japanese Unexamined Patent Application Publication No. 2010-215935 and Japanese Unexamined Patent Application Publication No. 2010-222624 of the same applicant, and have found that when a Vickers hardness of the surface after a heat treatment is decreased from a Vickers hardness of the surface after an aging treatment by 3 Hv to 20 Hv, by hot-rolling at a starting temperature of 930° C. to 1030° C. base material of the Cu—Zr-based copper alloy, which is obtained by melting and casting a predetermined component, subjecting a copper alloy plate to a solution treatment in a rapid cooling treatment by water cooling from a temperature region of equal to or more than 600° C. and then, subjecting the copper alloy plate to cold rolling, subjecting the copper alloy plate to an aging treatment at 320 to 460° C. for 2 to 8 hours, and subjecting the copper alloy plate to a heat treatment at 500° C. to 750° C. for 10 to 40 seconds, an average value of KAM values measured by an EBSD method using a scanning electron microscope equipped with a backscattered electron diffraction image system is 1.5° to 1.8°, a balance of bending formability and bending elastic limit is achieved at a high level, and further, satisfactory mechanical strength can also be retained.

That is, there is provided a copper alloy plate of the invention containing, by mass %, 0.05% to 0.2% of Zr; and a remainder including Cu and unavoidable impurities, in which an average value of KAM values measured by an EBSD method using a scanning electron microscope equipped with a backscattered electron diffraction image system is 1.5° to 1.8°, an R/t ratio is 0.1 to 0.6 in which R represents the minimum bending radius which does not cause a crack, and t represents the thickness of the plate in a W bending test, and bending elastic limit is 420 $N/mm^2$ to 520 $N/mm^2$.

When the average value of KAM values is lower than 1.5°, bending elastic limit is decreased, and tensile strength is decreased, and when the average value is more than 1.8°, bend formability is decreased, and bending elastic limit is also decreased.

The copper alloy plate of the invention may contain, by mass %, 0.2 ppm to 400 ppm of B or 0.001% to 0.3% of Co.

By adding these elements, a crystalline texture becomes even and tight to obtain a stabilizing effect and to impart an appropriate elongation (ductibility). When the addition amount of each element is less than the lower limit, the stabilizing effect is not sufficient, and when the addition amount of each element is more than the upper limit, the ductibility is remarkably increased and tensile strength is decreased.

There is provided a process for manufacturing the copper alloy plate of the invention including hot-rolling a base material of a copper alloy at a starting; subjecting a copper alloy plate to a solution treatment in a rapid cooling treatment by Water cooling from a temperature region of equal or more than 600° C. and then, subjecting the copper alloy plate to cold rolling; subjecting the copper alloy plate to an aging treatment at 320° C. to 460° C. for 2 to 8 hours; and subjecting the copper alloy plate to a heat treatment at 500° C. to 750° C. for 10 to 40 seconds, in which a Vickers hardness of the surface of the copper alloy plate after the heat treatment is decreased from a Vickers hardness of the surface of the copper alloy plate after the aging treatment by 3 Hv to 20 Hv.

The copper alloy plate, in which Zr is solid-solved in an oversaturated state and the thickness of each crystal grain layer is even, is manufactured by hot-rolling a base material of a copper alloy at a starting temperature of 930° C. to 1030°; and subjecting a copper alloy plate to a solution treatment in a rapid cooling treatment by water cooling from a temperature region of equal to or more than 600° C., and preferably subjecting the copper alloy plate to cold rolling to the thickness of the product.

The copper alloy plate after the cold rolling is subjected to the aging treatment at 320° C. to 460° for 2 to 8 hours, and Zr which is solid-solved in an oversaturated state is gradually precipitated by the aging treatment. Then, a basis material is produced in which an average value of KAM values measured by an EBSD method using a scanning electron microscope equipped with a backscattered electron diffraction image system, falls in a range of 1.5° to 1.8°.

When the treatment temperature is less than 320° C., there is an adverse influence on tensile strength, and when the treatment temperature is more than 460° C., there is an adverse influence on bending formability. When the treatment time is less than 2 hours, the effect of the aging treatment is not obtained and when the treatment time is more than 8 hours, recrystallization occurs, which is not preferable.

Next, the Vickers hardness of the surface of the copper alloy plate after the heat treatment is decreased from the Vickers hardness of the surface of the copper alloy plate after the aging treatment by 3 Hv to 20 Hv by subjecting the copper alloy plate after the aging treatment to the heat treatment at 500° C. to 750° C. for 10 to 40 seconds, and an average value of KAM values measured by an EBSD method using a scanning electron microscope equipped with a backscattered electron diffraction image system falls in a range of 1.5° to 1.8°.

Accordingly, a balance of bending formability and bending elastic limit is achieved at a high level and satisfactory mechanical strength can be retained.

When the treatment temperature is less than 500° C. or the treatment time is less than 10 seconds, the Vickers hardness is decreased by less than 3 Hv, and when the treatment temperature is more than 750° C. or the treatment time is more than 40 seconds, the Vickers hardness is decreased by more than 20 Hv.

Further, after the heat treatment, the copper alloy plate is preferably subjected to rapid cooling by water cooling in order to obtain a tight crystalline texture by solid-solving the Zr in an oversaturated state.

Advantageous Effects of Invention

In the invention, a Cu—Zr-based copper alloy plate for electric and electronic components is provided which has a balance of bending formability and bending elastic limit at a high level while retaining satisfactory mechanical strength, and a process for manufacturing the same.

DESCRIPTION OF EMBODIMENTS

Hereinafter, an embodiment of the invention will be described.

[Alloy Composition of Copper Alloy Plate]

A copper alloy plate of the invention contains 0.05% by mass to 0.2% by mass of Zr and a remainder including Cu and unavoidable impurities.

Zr (zirconium) is an alloy element which forms a compound with copper to be precipitated in a mother phase, and has an effect of improving the entire material strength and improving heat resistance. The content of Zr has an influence on the amount and size of precipitation particles to be formed, and causes a balance of conductivity and strength to be changed. However, good properties of achieving a balance of conductivity and strength at a high level are realized by allowing Zr to be contained with the concentration in the above range.

When the content of Zr is less than 0.05% by mass, Cu—Zr precipitate is not sufficient so that age hardening is not satisfactory and satisfactory stress relaxation properties are not easily obtained. When the content is more than 0.2% by mass, the form of the Cu—Zr precipitate easily becomes coarse and an effect of improving strength is not obtained, which becomes a significant cause of decreasing bending formability.

Further, the copper alloy plate of the invention may contain, by mass %, 0.2 ppm to 400 ppm of B, or 0.001% to 0.3% of Co.

By adding these elements, a crystalline texture becomes even and tight to obtain a stabilizing effect and to impart an appropriate elongation (ductibility). When the addition amount of each element is less than the lower limit, the stabilizing effect is not sufficient, and when the addition amount of each element is more than the upper limit, the ductibility is remarkably increased and tensile strength is decreased.

[Alloy Composition of Copper Alloy Plate]

In the Cu—Zr-based copper alloy plate of the invention, an average value of KAM (Kernel Average Misorientation) values, which is a misorientation among adjacent measurement points measured by an EBSD method using a scanning electron microscope equipped with a backscattered electron diffraction image system in the alloy composition, is 1.5° to 1.8°, the bending formability (R/t, in which R represents the minimum bending radius which does not cause a crack and t represents the thickness of the plate in a W bending test which will be described later) is 0.1 to 0.6, and the bending elastic limit is 420 $N/mm^2$ to 520 $N/mm^2$. While retaining satisfactory mechanical strength, the copper alloy plate has a balance of bending formability and bending elastic limit at a high level.

[KAM Measurement by EBSD Method]

KAM values were measured by an EBSD method as follows.

After a sample with a size of 10 mm×10 mm was mechanically polished and buffed, the sample was subjected to a surface adjustment by an ion milling device manufactured by Hitachi High-Technologies Corporation with an acceleration voltage of 6 kV, at an incident angle of 10° for an irradiation time of 15 minutes. Using an SEM (Model No. S-3400N) manufactured by Hitachi High-Technologies Corporation and an EBSD measurement and analysis system OIM (Orientation Imaging Mictograph) manufactured by TSL corporation, a measured region was separated into a hexagonal region (pixel) and a kikuchi pattern was obtained from the reflection electron of an electron beam incident on the surface of the sample to measure the orientation of the pixel in the separated region. The measured orientation data was analyzed using the analysis software (software name: OIM Analysis) of the same system to calculate various parameters. The conditions of the observation were an acceleration voltage of 25 kV and a measured area of 30.0 ∝m×300 ∝m, and the distance between adjacent pixels (step size) was 0.5 ∝m. A boundary in which a misorientation between adjacent pixels was equal to or more than 5° was considered as a crystal grain boundary.

Regarding the KAM value, the average misorientation between the pixels in the crystal grain and adjacent pixels in a range not exceeding the crystal grain boundary was calculated and an average value in all the pixels configuring the entire measured area was calculated.

When the average value of KAM values is less than 1.5°, bending elastic spring deflection limit is decreased and tensile strength is decreased, and when the average value is more than 1.8°, bending formability is decreased and bending elastic limit is also decreased.

[Process for Manufacturing Copper Alloy Plate]

A process for manufacturing the copper alloy plate of the invention includes hot-rolling a base material of a copper alloy at a starting temperature of 930° C. to 1030°; subjecting a copper alloy plate to a solution treatment in a rapid cooling treatment by water cooling from a temperature region of equal or more than 600° C. and then, subjecting the copper alloy plate to cold rolling; subjecting the copper alloy plate to an aging treatment at 320° C. to 460° C. for 2 to 8 hours; and subjecting the copper alloy plate to a heat treatment at 500° to 750° C. for 10 to 40 seconds, in which a Vickers hardness of the surface of the copper alloy plate after the heat treatment is decreased from a Vickers hardness of the surface of the copper alloy plate after the aging treatment by 3 Hv to 20 Hv.

The copper alloy plate, in which Zr is solid-solved in an oversaturated state and the thickness of each crystal grain layer is even, is manufactured by hot-rolling a base material of a copper alloy at a starting temperature of 930° C. to 1030°; and subjecting a copper alloy plate to a solution treatment in a rapid cooling treatment by water cooling from a temperature region of equal to or more than 600° C., and preferably subjecting the copper alloy plate to cold rolling to the thickness of the product.

The copper alloy plate after the cold rolling is subjected to the aging treatment at 320° C. to 460° C. for 2 to 8 hours, and Zr which is solid-solved in an oversaturated state is gradually precipitated by the aging treatment. Then, a basis material is produced in which an average value of KAM values measured by an EBSD method using a scanning electron microscope equipped with a backscattered electron diffraction image system, falls in a range of 1.5° to 1.8°.

When the treatment temperature is less than 320° C., there is an adverse influence on tensile strength, and when the treatment temperature is more than 460° C., there is an adverse influence on bending formability. When the treatment time is less than 2 hours, the effect of the aging treatment is not obtained and when the treatment time is more than 8 hours, recrystallization occurs, which is not preferable.

Next, the Vickers hardness of the surface of the copper alloy plate after the heat treatment is decreased from the Vickers hardness of the surface of the copper alloy plate after the aging treatment by 3 Hv to 20 Hv by subjecting the copper alloy plate after the aging treatment to the heat treatment at 500° C. to 750° C. for 10 to 40 seconds, and an average value of KAM values measured by an EBSD method using a scanning electron microscope equipped with a backscattered electron diffraction image system falls in a range of 1.5° to 1.8°.

Accordingly, a balance of bending formability and bending elastic limit is achieved at a high level and satisfactory mechanical strength can be retained.

When the treatment temperature is less than 500° C. or the treatment time is less than 10 seconds, the Vickers hardness is decreased by less than 3 Hv, and when the treatment temperature is more than 750° C. or the treatment time is more than 40 seconds, the Vickers hardness is decreased by more than 20 Hv.

Further, the copper alloy plate after the heat treatment is preferably subjected to rapid cooling by water cooling in order to obtain a tight crystalline texture by solid-solving the Zr in an oversaturated state.

EXAMPLES

A copper alloy with a composition shown in Table 1 was melted and casted to produce a base material of the copper alloy. Hot rolling was started with respect to the base material of the copper alloy at a temperature shown in Table 1 and a copper alloy plate was subjected to rapid water cooling at a rate of 40° C./sec from a temperature region of equal to or more than 600° C. to be subjected to a solution treatment. Next, the copper alloy plate was subjected to scalpig, rough rolling and polishing to produce copper alloy plates with a predetermined thickness.

Next, the copper alloy plates were subjected to cold rolling at a rolling reduction ratio shown in Table 1 to have a thickness of 0.5 mm which is the thickness of the product, and subjected to an aging treatment and a heat treatment at a temperature and time shown in Table 1. Then, the copper alloy plate was subjected to rapid water cooling at a rate of 50° C./sec to produce thin copper alloy plates shown in Examples 1 to 10 and Comparative Examples 1 to 6.

The Vickers hardness and KAM values of surface of each sample after the aging treatment and heat treatment were measured. The results are shown in Table 1.

Vickers hardness was measured based on JIS-Z2244.

KAM value measurement was performed by an EBSD method using a scanning electron microscope equipped with a backscattered electron diffraction image system as follows.

After a sample with a size of 10 mm×10 mm was mechanically polished and buffed, the sample was subjected to a surface adjustment by an ion milling device manufactured by Hitachi High-Technologies Corporation with an acceleration voltage of 6 kV, at an incident angle of 10° for an irradiation time of 15 minutes. Using an SEM (Model No. S-3400N) manufactured by Hitachi High-Technologies Corporation and an EBSD measurement and analysis system OIM (Orientation Imaging Mictograph) manufactured by TSL corporation, a measured region was separated into a hexagonal region (pixel) and a kikuchi pattern was obtained from the reflection electron of an electron beam incident on the surface of the sample to measure the orientation of the pixel in the separated region. The measured orientation data was analyzed using the analysis software (software name: OIM Analysis) of the same system to calculate various parameters. The conditions of the observation were an acceleration voltage of 25 kV and a measured area of 300 ∝m×300 ∝m, and the distance between adjacent pixels (step size) was 0.5 ∝m. A boundary in which a misorientation between adjacent pixels was equal to or more than 5° was considered as a crystal grain boundary.

Regarding the KAM value, the average misorientation between the pixels in the crystal grain and adjacent pixels in a range not exceeding the crystal grain boundary was calculated and an average value in all the pixels configuring the entire measured area was calculated.

Tensile strength was measured with a test piece of JIS No. 5.

Conductivity was measured based on JIS H0505.

For bending formability, a W bending test was performed based on JIS H3100. A bending axis was set in a rolling parallel direction (Bad Way direction), the minimum bending radius R (unit: mm) which does not cause a crack on the surface of the sample was measured to evaluate bending formability with an R/t ratio value of the minimum bending radius to the thickness t (unit: mm).

For bending elastic limit, a permanent deflection amount was measured by a moment type test based on JIS H3130, Kb0.1 (maximum surface stress value at a fixed end corresponding to permanent deflection amount of 0.1 mm) at R.T. was calculated.

TABLE 2

| | Tensile Strength ($N/mm^2$) | Conductivity (% IACS) | Bending Formability R/t | Bending Elastic Limit ($N/mm^2$) |
|---|---|---|---|---|
| Example 1 | 457 | 96 | 0.2 | 439 |
| 2 | 475 | 93 | 0.3 | 457 |
| 3 | 513 | 91 | 0.4 | 488 |
| 4 | 442 | 95 | 0.3 | 429 |
| 5 | 537 | 88 | 0.6 | 517 |
| 6 | 471 | 89 | 0.4 | 454 |
| 7 | 464 | 97 | 0.2 | 432 |
| 8 | 480 | 92 | 0.1 | 461 |
| 9 | 446 | 95 | 0.1 | 425 |
| 10 | 492 | 88 | 0.1 | 468 |
| Comparative Example 1 | 405 | 95 | 1.0 | 330 |
| 2 | 427 | 97 | 1.0 | 324 |
| 3 | 416 | 94 | 1.1 | 316 |
| 4 | 398 | 93 | 0.2 | 306 |
| 5 | 462 | 96 | 0.9 | 320 |
| 6 | 386 | 95 | 0.8 | 327 |

From the results, the Cu—Zr-based copper alloy plate of the invention has a balance of bending formability and bending elastic limit at a high level, while retaining satisfactory mechanical strength, and is particularly preferably applicable to electric and electronic components.

TABLE 1

| | Zr (%) | B (ppm) | Co (%) | Hot Rolling Starting Temperature (° C.) | Cold Rolling Reduction Ratio (%) | Aging Temperature (° C.) | Aging Time (H) | Hardness After Aging (Hv) | Heat Treatment Temperature (° C.) | Heat Treatment Time (S) | Hardness After Heat Treatment (Hv) | Change in Hardness (Hv) | Average Value of KAM Values (°) |
|---|---|---|---|---|---|---|---|---|---|---|---|---|---|
| Example 1 | 0.09 | | | 960 | 94 | 360 | 4 | 139 | 600 | 30 | 129 | 10 | 1.63 |
| 2 | 0.12 | | | 1000 | 94 | 340 | 6 | 144 | 700 | 20 | 132 | 12 | 1.69 |
| 3 | 0.14 | | | 980 | 96 | 380 | 8 | 153 | 750 | 10 | 144 | 9 | 1.72 |
| 4 | 0.10 | | | 930 | 96 | 400 | 2 | 140 | 550 | 40 | 123 | 17 | 1.65 |
| 5 | 0.20 | | | 1030 | 91 | 460 | 6 | 158 | 500 | 10 | 155 | 3 | 1.78 |
| 6 | 0.16 | | | 960 | 97 | 380 | 2 | 151 | 650 | 40 | 131 | 20 | 1.57 |
| 7 | 0.05 | | | 980 | 92 | 320 | 4 | 136 | 500 | 10 | 130 | 6 | 1.68 |
| 8 | 0.12 | 121 | | 1000 | 94 | 360 | 4 | 146 | 600 | 30 | 133 | 13 | 1.56 |
| 9 | 0.09 | | 0.1 | 960 | 96 | 380 | 6 | 138 | 700 | 20 | 124 | 14 | 1.58 |
| 10 | 0.08 | 32 | 0.08 | 1030 | 96 | 420 | 6 | 142 | 650 | 20 | 134 | 8 | 1.65 |
| Comparative Example 1 | 0.30 | | | 960 | 94 | 400 | 4 | 145 | 800 | 30 | 121 | 24 | 1.26 |
| 2 | 0.02 | | | 980 | 94 | 380 | 6 | 128 | 400 | 20 | 127 | 1 | 1.83 |
| 3 | 0.11 | | | 980 | 96 | 300 | 4 | 129 | None | None | 129 | 0 | 1.86 |
| 4 | 0.11 | | | 980 | 96 | 360 | 4 | 141 | 800 | 60 | 118 | 23 | 1.16 |
| 5 | 0.08 | | | 960 | 94 | 480 | 4 | 139 | 400 | 7 | 138 | 1 | 1.87 |
| 6 | 0.08 | | | 960 | 94 | 310 | 0.5 | 112 | 500 | 8 | 110 | 2 | 1.25 |

Next, the tensile strength, conductivity, bending formability and bending elastic limit of each thin copper alloy plate were measured. These results are shown in Table 2.

The manufacturing process of the embodiment according to the invention has been described, but the invention is not limited to the description and can be variously modified within the scope which does not deviate from the concept of the invention.

INDUSTRIAL APPLICABILITY

The Cu—Zr-based copper alloy plate of the invention can be applied to electric and electronic components such as a connector which are exposed to a harsh usage environment of a high temperature and high vibration for a long period of time.

The invention claimed is:

1. A copper alloy plate consisting of, by mass %:

0.05% to 0.2% of Zr; and a remainder including Cu and unavoidable impurities, wherein an average value of KAM values measured by an EBSD method using a scanning electron microscope equipped with a backscattered electron diffraction image system is 1.5° to 1.8°, an R/t ratio is 0.1 to 0.6 in which R represents the minimum bending radius which does not cause a crack, and t represents the thickness of the plate in a W bending test, and bending elastic limit is 420 $N/mm^2$ to 520 $N/mm^2$, wherein the copper alloy plate is produced by a process including hot-rolling, solution treatment, cold rolling, aging treatment and heat treatment in this order, a Vickers hardness of the surface of the copper alloy plate after the heat treatment is decreased from a Vickers hardness of the surface of the copper alloy plate after the aging treatment by 3 Hv to 20 Hv.

2. A copper alloy plate consisting of, by mass %:

0.05% to 0.2% of Zr;

0.001% to 0.3% of Co;

a remainder including Cu and unavoidable impurities; and wherein an average value of KAM values measured by an EBSD method using a scanning electron microscope equipped with a backscattered electron diffraction image system is 1.5° to 1.8°, an R/t ratio is 0.1 to 0.6 in which R represents the minimum bending radius which does not cause a crack, and t represents the thickness of the plate in a W bending test, and bending elastic limit is 420 $N/mm^2$ to 520 $N/mm^2$, wherein the copper alloy plate is produced by a process including hot-rolling, solution treatment, cold rolling, aging treatment and heat treatment in this order, a Vickers hardness of the surface of the copper alloy plate after the heat treatment is decreased from a Vickers hardness of the surface of the copper alloy plate after the aging treatment by 3 Hv to 20 Hv.

3. A process for manufacturing the copper alloy plate according to claim 1, comprising:

hot-rolling a base material of a copper alloy at a starting temperature of 930° C. to 1030°;

subjecting a copper alloy plate to a solution treatment in a rapid cooling treatment by water cooling from a temperature region of equal or more than 600° C. and then, subjecting the copper alloy plate to cold rolling;

subjecting the copper alloy plate to an aging treatment at 320° C. to 460° C. for 2 to 8 hours; and subjecting the copper alloy plate to a heat treatment at 500° C. to 750° C. for 10 to 40 seconds, wherein a Vickers hardness of the surface of the copper alloy plate after the heat treatment is decreased from a Vickers hardness of the surface of the copper alloy plate after the aging treatment by 3 Hv to 20 Hv.

4. A process for manufacturing the copper alloy plate according to claim 2, comprising:

hot-rolling a base material of a copper alloy at a starting temperature of 930° C. to 1030°;

subjecting a copper alloy plate to a solution treatment in a rapid cooling treatment by water cooling from a temperature region of equal or more than 600° C. and then, subjecting the copper alloy plate to cold rolling;

subjecting the copper alloy plate to an aging treatment at 320° C. to 460° C. for 2 to 8 hours; and subjecting the copper alloy plate to a heat treatment at 500° C. to 750° C. for 10 to 40 seconds, wherein a Vickers hardness of the surface of the copper alloy plate after the heat treatment is decreased from a Vickers hardness of the surface of the copper alloy plate after the aging treatment by 3 Hv to 20 Hv.

* * * * *